US010246206B2

(12) United States Patent
Cox et al.

(10) Patent No.: US 10,246,206 B2
(45) Date of Patent: Apr. 2, 2019

(54) METHOD AND APPARATUS FOR PACKAGING GROUPS OF ARTICLES WHICH ARE COMBINED TO FORM PACKAGING UNITS

(71) Applicant: KHS GmbH, Dortmund (DE)

(72) Inventors: Bernd Cox, Weeze (DE); Michael Jörissen, Bedburg-Hau (DE)

(73) Assignee: KHS GmbH, Dortmund (DE)

( * ) Notice: Subject to any disclaimer, the term of this patent is extended or adjusted under 35 U.S.C. 154(b) by 465 days.

(21) Appl. No.: 14/423,521

(22) PCT Filed: Aug. 8, 2013

(86) PCT No.: PCT/EP2013/002381

§ 371 (c)(1),
(2) Date: Feb. 24, 2015

(87) PCT Pub. No.: WO2014/029469

PCT Pub. Date: Feb. 27, 2014

(65) Prior Publication Data

US 2015/0183539 A1 Jul. 2, 2015

(30) Foreign Application Priority Data

Aug. 24, 2012 (DE) ..... 10 2012 016 699

(51) Int. Cl.
*B65B 53/02* (2006.01)
*B65B 51/10* (2006.01)
(Continued)

(52) U.S. Cl.
CPC ..... *B65B 51/20* (2013.01); *B65B 11/12* (2013.01); *B65B 43/10* (2013.01); *B65B 49/08* (2013.01);
(Continued)

(58) Field of Classification Search
CPC ..... B65B 52/02; B65B 53/06; B65B 53/063; B65B 53/066; B65B 11/12; B65B 51/20; B65B 11/10
(Continued)

(56) References Cited

U.S. PATENT DOCUMENTS 3,057,125 A * 10/1962 Kenkman ..... B29C 65/10 53/370.9
3,362,128 A * 1/1968 James ..... B65B 53/02 100/306
(Continued)

FOREIGN PATENT DOCUMENTS

DE 42 07 725 9/1993
DE 199 57 415 5/2001
(Continued)

*Primary Examiner* — Stephen F. Gerrity
*Assistant Examiner* — Joshua G Kotis
(74) *Attorney, Agent, or Firm* — Occhiuti & Rohlicek LLP

(57) ABSTRACT

A method for packaging groups of articles to form packaging units, includes sheathing a packaging unit with a film as it moves in a running direction on a transporting path by simultaneously forming a film cover and flaps projecting beyond the packaging unit along a direction perpendicular to the running direction, and positioning the flaps against the packaging unit as the packaging unit moves through a folding unit, fixing the flaps, and forming a film wrapper that is closed on all sides of the packaging unit. A preliminary-fixing step, which includes positioning the flaps in relation to one another, and initially fixing the flaps by generating heat, and exposing the flaps to the heat, follows. This is followed by a definitive-fixing step that includes exposing the packaging unit, as a whole, to generated heat.

17 Claims, 7 Drawing Sheets

(51) Int. Cl.

| | |
|---|---|
| ***B65B 51/20*** | (2006.01) |
| ***B65B 49/08*** | (2006.01) |
| ***B65B 51/14*** | (2006.01) |
| ***B65B 53/06*** | (2006.01) |
| ***B65B 11/12*** | (2006.01) |
| ***B65B 43/10*** | (2006.01) |
| *B65B 11/00* | (2006.01) |
| *B65B 51/02* | (2006.01) |

(52) U.S. Cl.
CPC ..... *B65B 51/10* (2013.01); *B65B 51/14* (2013.01); *B65B 53/02* (2013.01); *B65B 53/063* (2013.01); *B65B 11/004* (2013.01); *B65B 51/02* (2013.01)

(58) Field of Classification Search
USPC ..... 53/442, 557, 48.2–48.8, 376.5, 376.6, 53/376.7, 376.8, 376.2, 377.7, 377.8, 209, 53/465, 466
See application file for complete search history.

(56) References Cited

U.S. PATENT DOCUMENTS 3,371,462 A * 3/1968 Nordkvist ..... B65B 27/04 206/432
3,381,443 A * 5/1968 Copping ..... B65B 53/063 219/388
3,468,412 A * 9/1969 Forman ..... B29C 66/73715 206/497
3,481,107 A * 12/1969 Kjell ..... B65B 11/48 53/229
3,488,913 A * 1/1970 Burgess ..... B65B 53/00 206/432
3,660,961 A * 5/1972 Ganz ..... B65B 11/10 53/210
3,739,547 A * 6/1973 Brevko ..... B65B 9/026 53/230
3,791,101 A * 2/1974 Monaghan ..... B65B 11/10 53/210
3,808,767 A 5/1974 Reid
4,036,362 A * 7/1977 Ullman ..... B65B 11/50 206/432
4,060,959 A 12/1977 Fiedler et al.
4,073,123 A 2/1978 Schoppee
4,430,844 A * 2/1984 James ..... B65B 9/067 53/141
4,609,101 A * 9/1986 Ullman ..... B65B 11/50 206/432
5,046,258 A * 9/1991 Cahill ..... B65B 51/18 53/206
5,058,361 A * 10/1991 Schmacher ..... B29C 65/10 53/370.9
5,175,978 A * 1/1993 Knauf ..... B65B 51/10 156/320
5,452,561 A * 9/1995 Thompson ..... B65B 13/02 53/176
6,516,589 B1 * 2/2003 Draghetti ..... B29C 66/8226 53/376.7
2009/0120045 A1 * 5/2009 Gorrieri ..... B65B 11/12 53/543
2011/0139664 A1 * 6/2011 Ageling ..... B65B 11/12 206/497

FOREIGN PATENT DOCUMENTS

| | | |
|---|---|---|
| DE | 10 2008 052633 | 4/2010 |
| DE | 10 2011 117 165 | 11/2012 |
| EP | 0 395 809 | 11/1990 |
| EP | 0 479 498 | 4/1992 |
| EP | 1 059 236 | 12/2000 |
| WO | WO2005/080206 | 9/2005 |
| WO | WO2012/149947 | 11/2012 |

* cited by examiner

METHOD AND APPARATUS FOR PACKAGING GROUPS OF ARTICLES WHICH ARE COMBINED TO FORM PACKAGING UNITS

RELATED APPLICATIONS

This application is the national stage, under 35 USC 371, of international application PCT/EP2013/002381, filed on Aug. 8, 2013, which claims the benefit of the Aug. 24, 2012 priority date of German application DE 10 2012 016699.0, the contents of which are herein incorporated by reference.

FIELD OF INVENTION

The invention concerns packaging, and in particular, packaging groups of articles to form packaging units.

BACKGROUND

It is known to combine articles into groups to form packaging units. The articles are generally bottles, such as plastic bottles. However, similar processing is carried out with cans.

The packaging unit is typically wrapped in plastic film that is then shrunk so that the articles form a stable packaging unit. The articles are secured against each other by means of the shrink-wrap film.

It is known to form pairs of flaps that are then folded around horizontal or vertical axes. After being folded, the flaps are then exposed to heat for welding.

A problem that sometimes arises is that the flaps can at least partially come loose. Thus, the film wrapper, which should be closed on all sides, develops an unintentional opening in the area of the flaps. In the extreme case, articles can fall through this hole. This is particularly true when the articles are very heavy. Heavy drink cans and bottles are thus particularly vulnerable to being lost in this way.

It is known to secure individual flaps reciprocally in the overlap area by using an existing or introduced adhesive or by a weld. A shrink process then takes place in a shrink tunnel. This improves the stability of the resulting packaging unit. However, even with this process, individual flaps may be unintentionally open as a result of the deformation associated with the shrinking.

SUMMARY

Among the objects of the invention is that of avoiding unintentional opening of the folding flaps, hereafter referred to as "flaps," during the shrinking process.

To promote achievement of this object, one aspect of the invention features a two-stage method of fixing the flaps in relation to one another. The method includes initially fixing the flaps in a preliminary manner under the action of heat. The packaging unit in its entirety is fixed in a definitive manner under the action of heat.

In the context of the invention, the vertically oriented flaps are at least partially laminated in the course of the preliminary fixing. i.e. the flaps undergo a reciprocal bonding to one another. This bond is designed so that the flaps cannot unintentionally come loose in the subsequent definitive-fixing step and the associated shrink process. As a general rule, the preliminary fixing is carried out so that the base films of the flaps to be bonded are suitable for bonding to each other by a lamination process, without a further bonding agent or glue being required. This can be ensured by carrying out an appropriate treatment of surface quality, and in particular, a corona treatment.

In this process, the flaps undergo a positioning in relation to one another at the same time. In this way, the flaps maintain their relative position to each other in the preliminary fixing or the lamination. At the end of the preliminary fixing, the flaps ensure a perfect lateral seal of the film wrapper. This seal remains intact at all times. If the packaging unit prepared in this way with the film wrapper now enters, for example, a shrink tunnel for the definitive-fixing step, the seal that binds the flaps to each other is very unlikely to be broken. The definitive-fixing step ensures that the film wrapper is shrunk in its entirety without affecting the lateral sealing by the flaps. The invention thus provides a separation between the preliminary fixing and lamination on the one hand and the definitive fixing and shrinking on the other. In this way, the overall energy furnish in the area of the flaps can be increased compared to previous procedures.

The increased and targeted energy furnish in the area of the flaps by the preliminary fixing ensures that the flaps maintain their lateral seal on the packaging unit achieved in this way, and do not experience any unintentional opening during the subsequent shrink process or the definitive fixing. Moreover, the increased energy furnish in the area of the flaps takes account of the fact that the film wrapper is multi-layered in this area and that the individual flaps have to be laminated to one another before the actual shrinking can take place.

An advantage of the invention is that the film around the packaging unit or the film wrapper stays in position in an optimum manner during the entire processing operation.

In another aspect of the invention, vertical flaps on a packaging unit are fixed in a preliminary manner subsequent to a folding unit and before the packaging unit is transferred into a shrink tunnel. In some embodiments, the preliminary fixing can be carried out together with the actual folding operation in the folding unit. In other embodiments, the folding unit and a preliminary-fixing unit, and a definitive-fixing unit are designed separately and independently of each other.

The flaps can be fixed in a preliminary manner by a heat source that extends in a longitudinal direction. In a preferred embodiment, it is possible to carry out the preliminary fixing of the flaps with the use of a heat source that moves with the flaps or the packaging unit in its entirety.

In another embodiment, the invention includes carrying out the preliminary fixing with a clamping element.

Some embodiments combine the functions of heating and clamping. Among these are embodiments that provide a continuously rotating heating tape or a heating chain. A major advantage of these embodiments is that there is no relative movement between the flaps and the heating element, and that the surface of the accompanying heating element can be designed and made in such a way so that only precisely defined flap areas are heated or so that different amounts of heat are provided for different flap areas.

In the course of preliminary fixing, the flaps undergo not only a reciprocal bonding, but, at the same time, a positioning in relation to one another. Thus, positioning and laminating of the flaps take place simultaneously. The positioning is executed by a clamping element that clamps the flaps onto the packaging unit. The clamping element ensures that the flaps positioned against the packaging unit by the folding unit remain lying in this position, against the packaging unit, during the preliminary fixing. At the same time, the clamping element can provide the necessary heat for the lamination.

To be able to carry out the preliminary fixing properly in this context, the heat source and/or the clamping element are provided with a non-stick coating. This suppresses any tendency of the flaps to adhere to on the heat source or to the clamping element as they pass through the associated preliminary-fixing unit.

In another aspect, the invention features an apparatus for packaging groups of articles combined to form packaging units. The apparatus concerned is suitable particularly for carrying out the described method.

According to the invention a folding unit, a preliminary-fixing unit, and a definitive-fixing unit are designed to be separate from each other. In some embodiments, the preliminary-fixing unit is adjacent to the folding unit, and the definitive-fixing unit follows the preliminary-fixing unit. As a general rule, the procedure is such that the folding unit, the preliminary-fixing unit, and the definitive-fixing unit immediately follow each other in a running direction of the packaging unit.

Fitting the preliminary-fixing unit with its own heat source is particularly useful. The heat source can be a stationary heat source that extends in a longitudinal direction. Alternatively, it can be a moving heat source that moves with the packaging unit. In either case, it is particularly advantageous if the heat source is completely or partially supplied with energy by the definitive-fixing unit. One way to achieve this is to have the heat source of the preliminary-fixing unit extend through to the definitive-fixing unit so that it can capture and deliver heat from the definitive-fixing unit.

In order for the flaps to be properly fixed in a preliminary manner, positioned, and irreversibly laminated, the preliminary-fixing unit ensures that the flaps are simultaneously mechanically loaded and exposed to heat. Mechanical loading in the preliminary-fixing unit can take place in several ways. One way is to use a clamping element. Alternatively or additionally, the flaps can however be mechanically loaded by exposure to an airstream that is appropriately directed for the reciprocal positioning and orientation of the flaps relative to the packaging unit.

To suppress adhesion between the flaps and either the clamping element and/or the heat source during reciprocal lamination thereof, a suitable coating is provided on either the clamping element or the heat source. The coating is applied at least on a side facing the flaps. This coating suppresses the tendency to have such adhesions.

In some embodiments, the definitive-fixing unit is a shrink tunnel or a comparable element that carries out the desired shrinking of the film around the packaging unit.

The invention thus promotes a safe sealing of the articles in a product package and a film wrapper closed on all sides. In this way, the method and the apparatus are able to make packaging units from heavy objects, such as cans or other articles of a significant weight without the concern that they might tear through a film wrapper during transport.

The preliminary fixing step, including the simultaneous positioning of the flaps in the preliminary fixing stage, significantly reduces the likelihood that the film wrapper is unintentionally opened in the area of the flaps in the course of the subsequent shrink process. A particular advantage of the invention is that the film wrapper is completely closed and that it remains completely closed.

In one aspect, the invention features a method that includes sheathing a particular packaging unit in its running direction on a transporting path with a film. This results in simultaneously forming a film cover and flaps projecting beyond the packaging unit in each case along transverse peripheries. This is followed by positioning the vertically oriented flaps against the packaging unit as the latter runs through the folding unit, and subsequent and/or simultaneous reciprocal fixing of the flaps forming a film wrapper which is closed on all sides.

In another aspect, the invention features a method for packaging groups of articles to form packaging units. Such a method includes sheathing a packaging unit, positioning flaps, executing a preliminary-fixing step, and executing a definitive-fixing step. Sheathing a packaging unit includes sheathing with a film as the packaging unit moves in a running direction on a transporting path and simultaneously forming a film cover and the flaps. The flaps project beyond the packaging unit along a transverse direction that is perpendicular to the running direction. Positioning the flaps includes positioning the flaps against the packaging unit as the packaging unit moves through a folding unit, fixing the flaps, and forming a film wrapper that is closed on all sides of the packaging unit. Executing the preliminary-fixing step includes positioning the flaps in relation to one another, and initially fixing the flaps at least in part by generating heat and exposing the flaps to the heat. Executing a definitive-fixing step includes exposing the packaging unit, as a whole, to generated heat.

In some practices, executing a preliminary-fixing step includes at least partially laminating the flaps. Among these practices are those that include exposing the flaps to a heat source. The heat source can be one that extends in a longitudinal direction along the running direction, or one that actually moves in the running direction.

In other practices, at least partially laminating the flaps includes using a clamping element for laminating the flaps. Among these practices are those that include using a clamping element that is arranged on both sides and parallel to the transport direction.

In yet other practices, executing the preliminary-fixing step includes executing the preliminary-fixing step after the packaging unit has passed through the folding unit and before the packaging unit has entered a definitive-fixing unit.

In another aspect, the invention features an apparatus for packaging groups of articles that are combined to form packaging units. Such an apparatus includes a sheathing unit, a folding unit, and a fixing device that includes a preliminary-fixing unit and a definitive-fixing unit. The sheathing unit is configured for sheathing a packaging unit on a transporting path in a running direction thereof with a film and for simultaneously forming a film cover and flaps that project beyond the packaging unit in a transverse direction that is perpendicular to the transporting path. The folding unit is configured for positioning the flaps against the packaging unit as the packaging unit passes through the folding unit. The fixing device is configured for at least reciprocal fixing of the flaps in relation to one another. The preliminary fixing unit is configured to apply heat to the flaps for reciprocal preliminary fixing of the flaps. The definitive fixing unit is configured for applying heat to the packaging unit as a whole and definitively fixing the packaging unit using at least the heat.

In some embodiments, the preliminary-fixing unit immediately follows the folding unit in the running direction, and the definitive-fixing unit follows the preliminary fixing unit in the running direction.

In other embodiments, the preliminary-fixing unit includes a stationary heat source that extends in a longitudinal direction parallel to the running direction. Among these are embodiments in which the definitive-fixing unit is configured to supply energy to the stationary heat source, and those in which the stationary heat source extends into the definitive-fixing unit.

In yet other embodiments, the preliminary-fixing unit includes a moving heat source that moves in a longitudinal direction parallel to the running direction. Among these are embodiments in which the definitive-fixing unit is configured to supply energy to the moving heat source, and embodiments in which the moving heat source extends into the definitive-fixing unit.

Further embodiments include those in which the preliminary-fixing unit is configured to mechanically load the flaps, and to expose the flaps to heat concurrently with loading the flaps.

Among the embodiments are those in which the preliminary-fixing unit includes a clamping element that is configured to mechanically load the flap and to carry out reciprocal positioning and orientation of the flap relative to the packaging unit.

In alternative embodiments, the preliminary-fixing unit includes a source of an air current. The source is configured for mechanically loading the flap, and for reciprocal positioning and orientation of the flap relative to the packaging unit.

Further embodiments include those that have a coating that is oriented to face the flaps and disposed on a substrate to suppress adhesion between the substrate and the flaps. Among these are embodiments in which the substrate is a clamping element and those in which the substrate is a heat source.

In yet other embodiments, the definitive fixing unit includes a shrink tunnel.

In alternative embodiments, the preliminary-fixing unit immediately follows the folding unit in the running direction, and the definitive-fixing unit immediately follows the preliminary-fixing unit in the running direction.

In another aspect, the invention features a method for packaging groups of articles to form packaging units, includes sheathing a packaging unit with a film as it moves in a running direction on a transporting path by simultaneously forming a film cover and flaps projecting beyond the packaging unit along a direction perpendicular to the running direction, and positioning the flaps against the packaging unit as the packaging unit moves through a folding unit, fixing the flaps, and forming a film wrapper that is closed on all sides of the packaging unit. A preliminary-fixing step, which includes positioning the flaps in relation to one another, and initially fixing the flaps by generating heat, and exposing the flaps to the heat, follows. This is followed by a definitive-fixing step that includes exposing the packaging unit, as a whole, to generated heat.

BRIEF DESCRIPTION OF THE DRAWINGS

These and other features of the invention will be apparent from the following detailed description, and the accompanying figures, in which.

DETAILED DESCRIPTION

Figure 1:
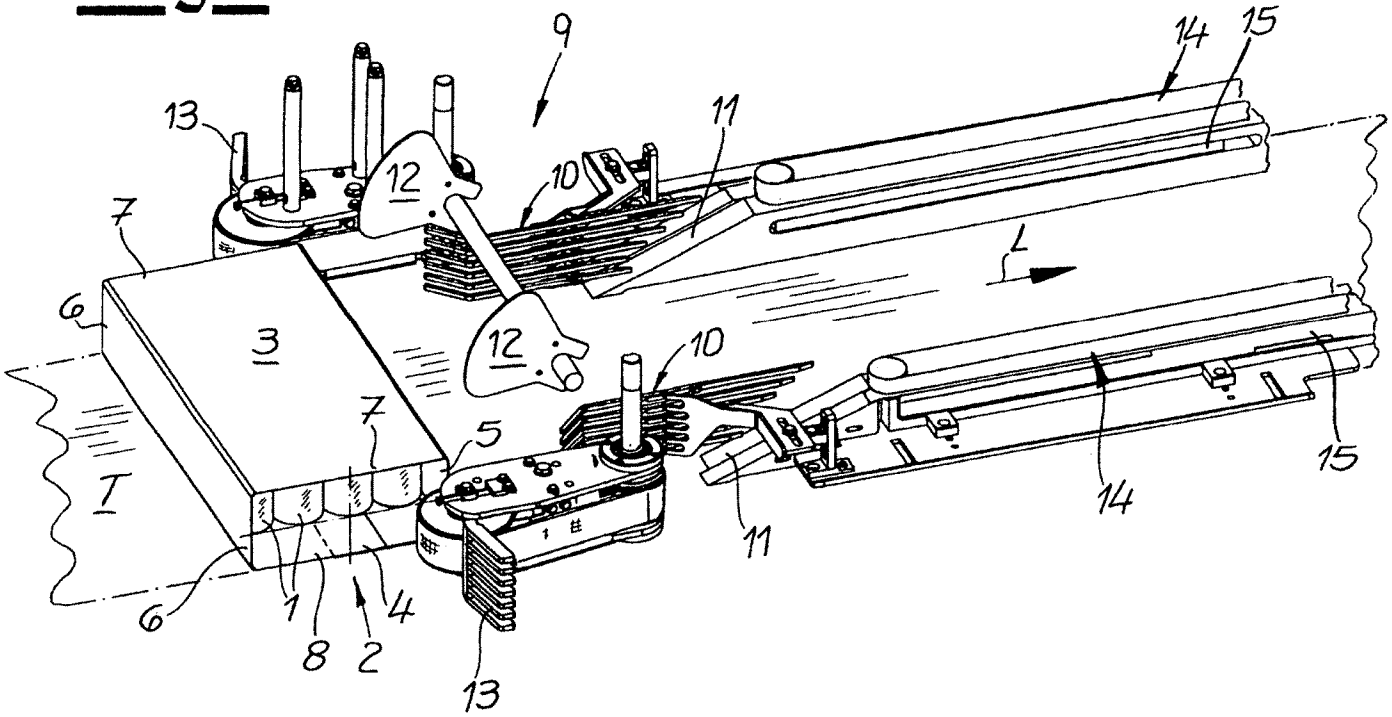
FIG. 1 shows an apparatus in schematic form with a folding unit and a preliminary-fixing unit.
Figure 2:
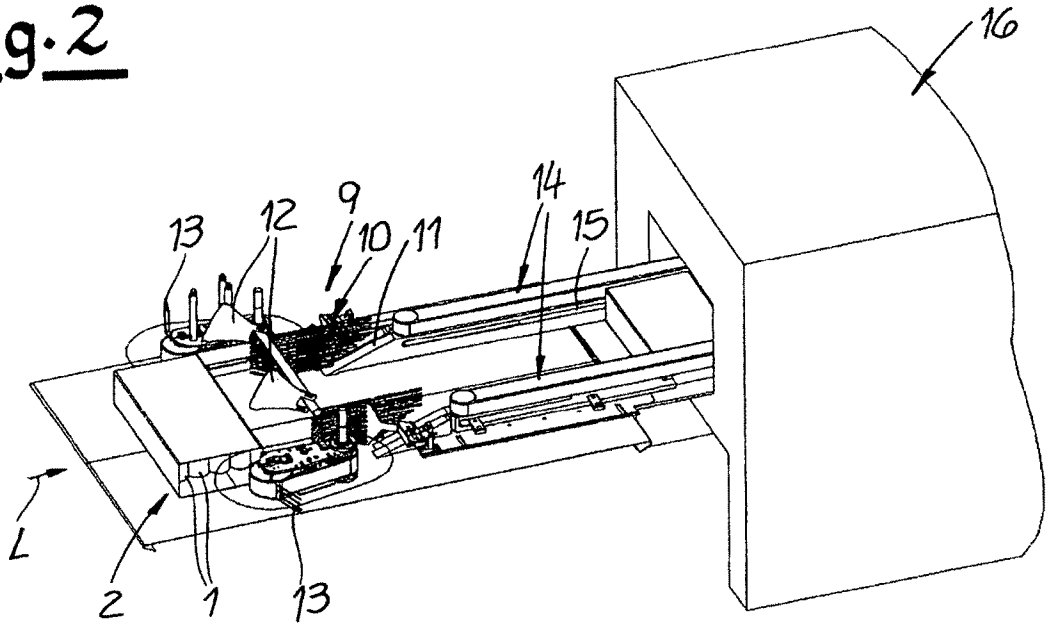
FIG. 2 shows the apparatus of FIG. 1 with a definitive-fixing unit.

FIGS. 1 and 2 shown an apparatus for packaging articles 1 that have been combined into groups to form packaging units 2. In the particular embodiment shown, the articles 1 are cans that have been arranged in a matrix. However, other articles can also be combined and processed by the illustrated apparatus.

The actual grouping of the articles 1 to form the packaging unit 2 is carried out by appropriate sorting and orienting devices upstream of the apparatus. These devices need not be illustrated in detail.

Also implicitly present, but not illustrated in the figures, is a feed drum for feeding a film 3 placed around the packaging unit 2 as illustrated in FIG. 1. In the illustrated embodiment, the film 3 is a shrinkable plastic film, such as a film made of PE (polyethylene), PET (polyethylene terephthalate), PP (polypropylene).

The sheathing of the particular packaging unit 2 occurs when, as it proceeds in a running direction L during the transport of the group of articles 1 along a transporting path T, it passes over a front end of a film wrap that has been cut and fed through a slot in the transporting path T.

As the packaging unit 2 proceeds further along the transporting path T, a film-carrier bar under the film wrap travels from below and describes a circular path, or a generally circular path, under the packaging unit 2 in the running direction L. The film-carrier bar then enters another slot, taking the rear end of the film wrap with it as it does so. When transporting the thus wrapped packaging unit 2 in the running direction L, the latter travels over the slot and thereby pulls the front end of the film wrap under it. In this way, the packaging unit 2 stands on the overlapping ends of the film wrap. As it does so, it defines a film cover 4. Further details of the described sheathing method are described in DE 42 07 725 A1.

The foregoing procedure defines a plurality of flaps 5-8 that project beyond end faces of the packaging unit 2 in a transverse direction that is perpendicular to the running direction L. First and second flaps 5-6 lie opposite each other and extend in planes perpendicular to that defined by the transporting path T. The first and second flaps 5-6 are arranged on the packaging unit 2 by a largely vertical folding process as the packaging unit 2 enters a folding unit 9. Third and fourth flaps 7, 8 also lie opposite each other and extend in planes parallel to that defined by the transporting path T. The third and fourth flaps 7-8 are likewise positioned against the packaging unit 2 by a largely horizontal folding operation. The particular folding operations are indicated in FIG. 1 by corresponding fold lines.

In the illustrated embodiment, the folding unit 9 includes first and second stationary folding-elements 10, 11. The first stationary folding-element 10 is a clamping rail. The second stationary folding-element 11 is a diagonal guide 11.

The folding unit 9 also includes first and second moving folding-elements 12-13. The moving folding-elements 12-13 move synchronously with the packaging unit 2 as it travels along the transporting path T in the running direction L. The first moving folding element 12 is a rotating folding disc 12. The second moving folding element 13 is a folding carrier 13 that moves with the packaging unit 2. As the packaging unit 2 passes through it, the folding unit 9 positions the flaps 5-8 against the packaging unit 2, as is illustrated in FIGS. 4A to 4D. Because folding units are known, there is no need for further details of the folding operation or the construction of the folding unit 9.

The folding unit 9, which is arranged after the sheathing unit, folds the flaps 5-8 against the packaging unit 2 as the packaging unit 2 moves through.

Downstream of the folding unit 9 is a fixing device 14-16 for reciprocal fixing of the flaps 5-8 relative to each other. In the illustrated embodiment, the fixing device 14-16 includes two fixing units: preliminary-fixing unit 14-15 and a definitive-fixing unit 16.

Although other kinds of definitive-fixing unit 16 can be used, in the illustrated embodiment, the definitive-fixing unit 16 is a shrink tunnel that is fitted with its own heat source inside it. Examples of a heat source include a hot-air blower with nozzles, and an infrared heating element.

The preliminary-fixing unit 14-15 ensures that the film wrapper formed by the film 3 is closed on all sides, and that it remains closed on all sides during the shrink process in the definitive-fixing unit 16. The preliminary-fixing unit 14-15 guarantees that the flaps 5-8 are simultaneously positioned in relation to one another and initially fixed, in a preliminary manner, by heat. The entire packaging unit 2 then undergoes a definitive fixing, again by heat, in the definitive-fixing unit 16.

The preliminary-fixing unit 14-15 follows the folding unit 9. In the illustrated embodiment, the preliminary-fixing unit 14-15 immediately follows the folding unit 9 so that there are no further elements or units placed between them. The definitive-fixing unit 16 then follows the preliminary-fixing unit 14-15. Preferably, the definitive-fixing unit 16 is directly adjacent to the preliminary-fixing unit 14-15, with no other units or elements being placed between them.

Figure 3:
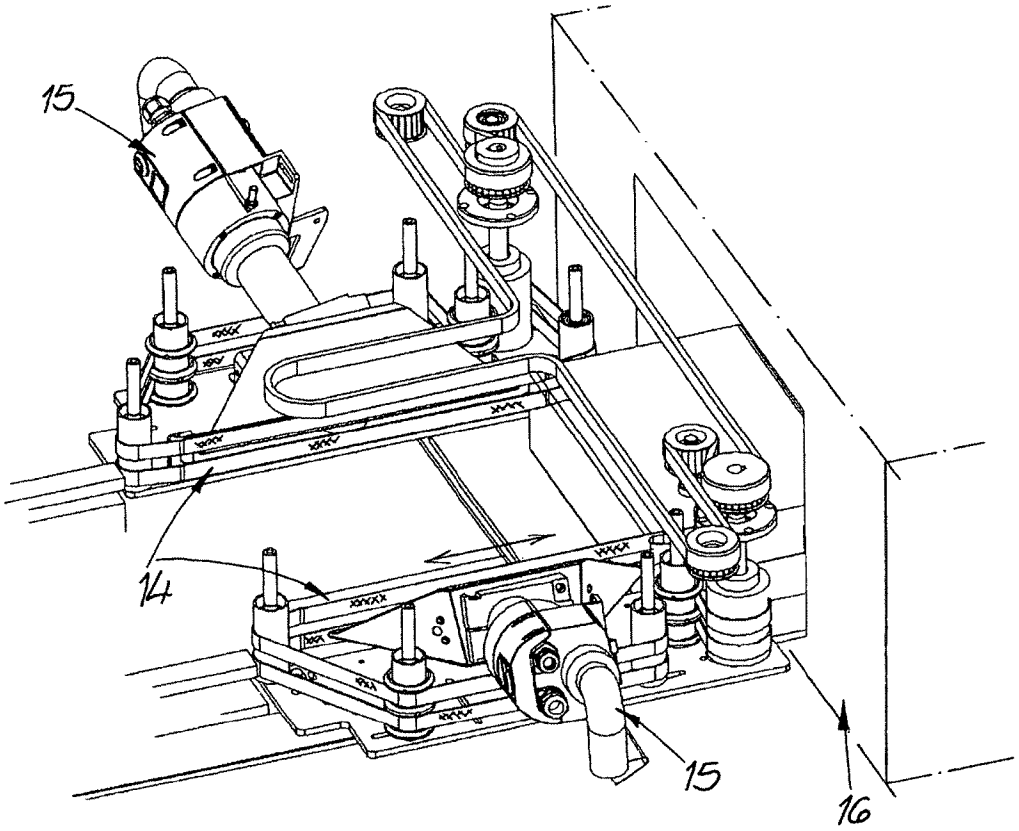
FIG. 3 shows an alternative embodiment of the preliminary-fixing unit.

In some embodiments, the preliminary-fixing unit 14-15 includes a stationary heat source 15 extending in a longitudinal direction, as shown in FIGS. 4A-4D. In other embodiments, the heat source 15 moves with the packaging unit 2 as the packaging unit 2 moves along the transporting path T in the running direction L, as shown in FIG. 3.

The preliminary-fixing unit 14-15 also has a clamping element 14. In some embodiments, the heat source 15 and the clamping element 14 are separate from each other. However, in other embodiments, the clamping element 14 and the heat source 15 form a module as illustrated in FIG. 4D.

The clamping element 14 holds the flaps so that they lie against the packaging unit 2 in the position imposed by folding unit 9 as the packaging unit 2 moves moving through the preliminary-fixing unit 14-15. In this way, the preliminary-fixing unit 14-15 mechanically loads the flaps 5-8 and, at the same time, exposes them to heat.

In FIG. 3 and FIGS. 4A-4C, the heat source 15 is a stand-alone component of the preliminary-fixing unit 14-15 that is independent of the heat source in the definitive-fixing unit 16. However, in the embodiment shown in FIG. 4D, the heat source 15 is supplied with energy in whole or in part from the definitive-fixing unit 16 or the shrink tunnel. In this embodiment, the heat source 15 of the preliminary-fixing unit 14-15 reaches or can reach through into the definitive-fixing unit 16.

Figure 4A:
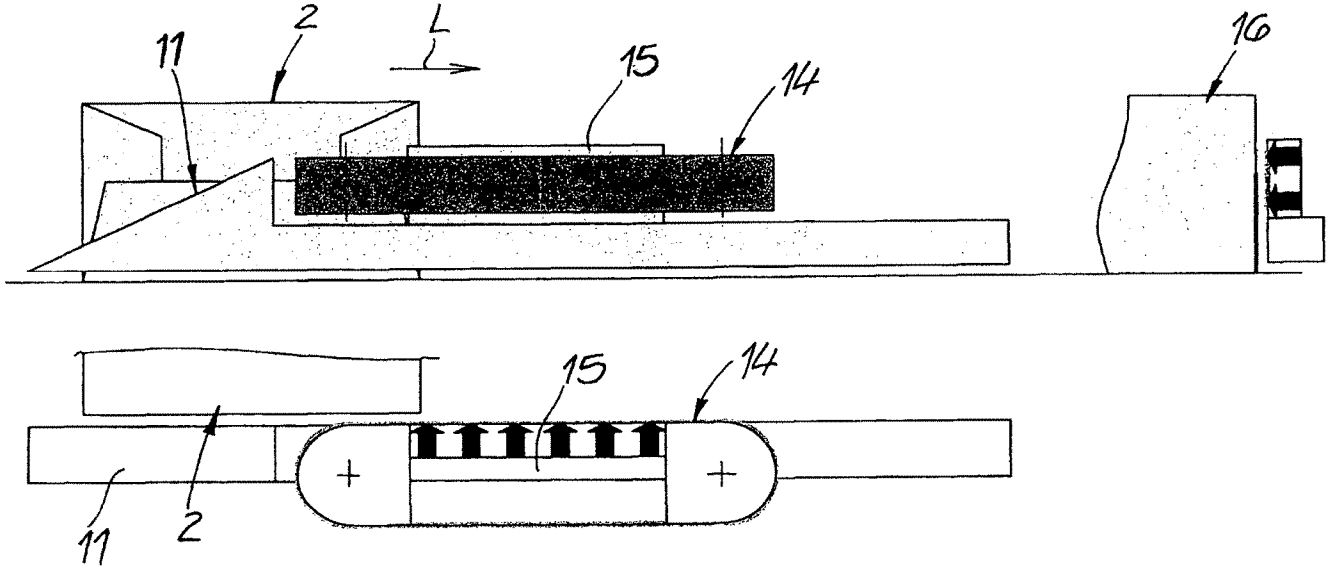
FIG. 4A-4D show additional embodiments of the preliminary-fixing unit in schematic form.
Figure 4B:
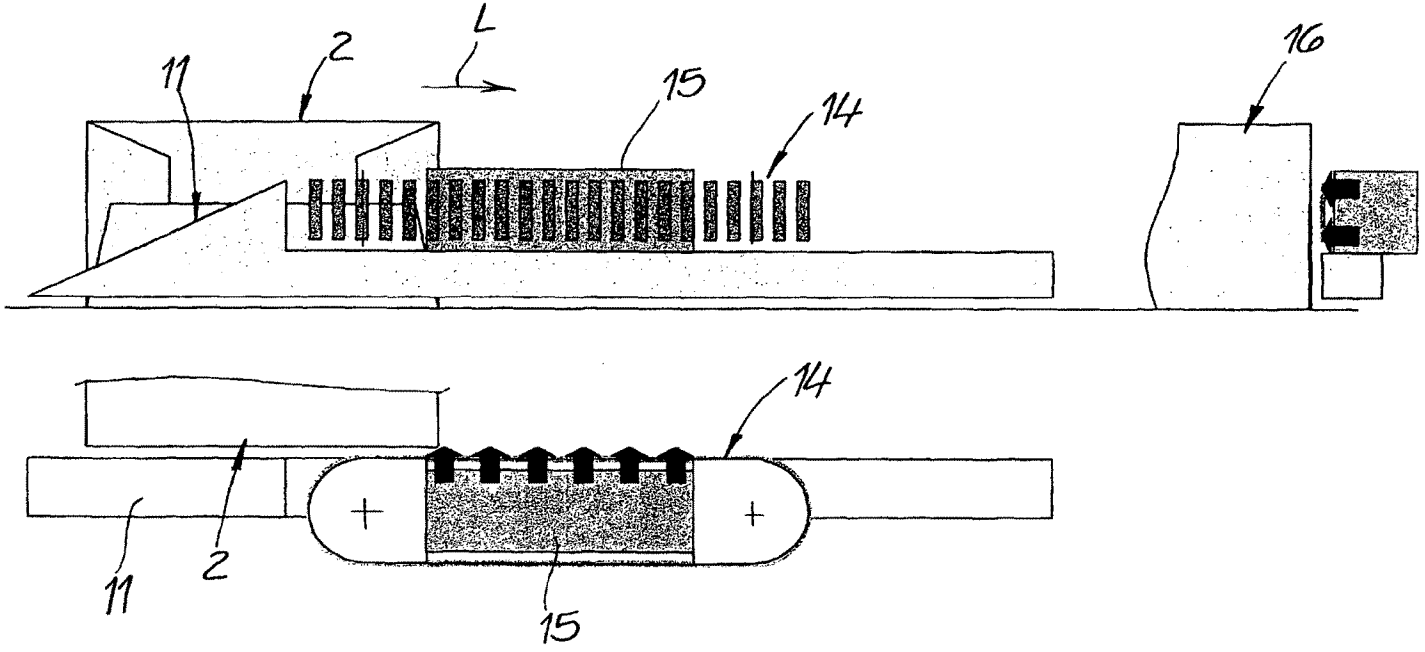
Figure 4C:
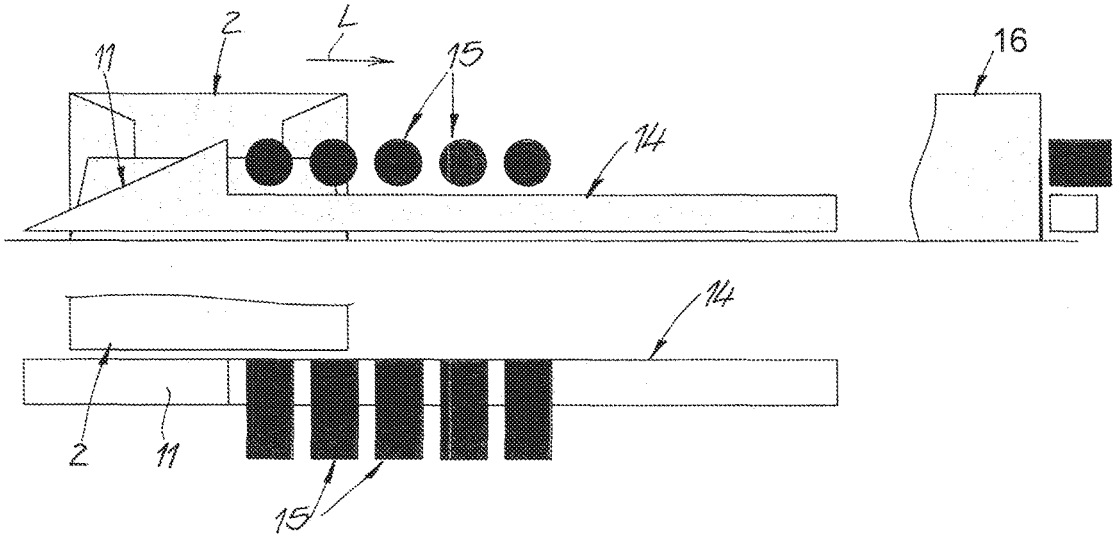
Figure 4D:
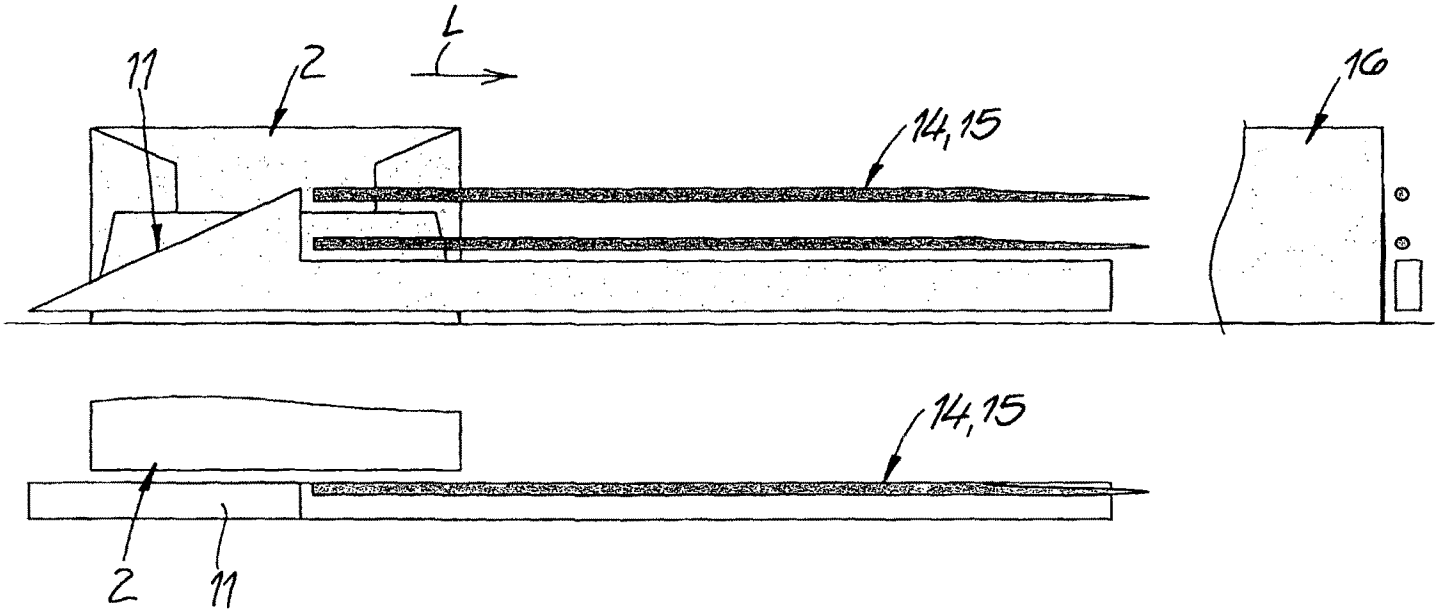

In FIG. 4D, the heat source 15 comprises a guide or two fixed guides that extend into the shrink tunnel and at the same time function as the clamping element 14. In this way, a heat source located in the shrink tunnel supplies energy to the heat source 15 via the guides.

Within the shrink tunnel, nozzles can be made as components of the previously mentioned hot-air blower to direct hot air against the packaging unit 2. At the same time, these nozzles also direct hot air at the guides 14 and at the heat source 15.

The preliminary-fixing unit 14-15 mechanically loads the flaps 5-8 using the clamping element 14. However, there are other ways to mechanically load the flaps 5-8. For example, it is also possible to position and orient the flaps 5-8 relative to each other by an air current.

FIG. 4B shows a clamping element 14 is designed as a rotating chain. The chain runs around the stationary heat source 15. In this way, the heat source 15 is able to expose the flaps 5-8 to appropriate hot air currents in the way and manner described or can ensure that the flaps 5-8 remain positioned against the packaging unit 2 as the packaging unit 2 moves through the preliminary-fixing unit 14-15, as shown by corresponding arrows in FIG. 4B. In addition, the clamping element 14, or the chain, ensures the desired positioning.

In another embodiment, shown in FIG. 4A, the clamping element 14 is a rotating tape. The heat source 15 exposes the rotating tape 14 to heat, thus heating the rotating tape and enabling it to reradiate heat for laminating the flaps 5-8 onto them. At the same time, the clamping element 14 ensures that the flaps 5-8 remain positioned against the packaging unit 2 as it moves through the preliminary-fixing unit 14-15. In some embodiments, the rotating of the clamping element 14 is a tape made of polytetrafluorethylene. Like the chain shown in FIG. 4B, the tape moves along the transporting path T at the same speed as the packaging unit 2 in the running direction L.

In FIG. 4C, stationary heating nozzles form the heat source 15. In addition, a guide 14 underneath the heating nozzles or the heat source 15 holds the flaps 5-8 positions them against the packaging unit 2 as it moves through the preliminary-fixing unit 14-15. The heat source 15 ensures that the flaps 5-8 are exposed to heat and immediately laminated.

In some embodiments, energy-rich radiators, such as infrared heaters replace the heating nozzles. These infrared heaters enable the use of appropriate shields form very a well-defined zone of action. This is difficult to do heating gas. The use of radiators, such as infrared radiators, is also advantageous for other embodiments described herein.

Both the clamping element 14 and the heat source 15 receive a coating on at least a side that faces the flaps 5-8. This coating can be a polytetrafluorethylene coating. Such a coating suppresses adhesion from the lamination occurring as the flaps 5-8 pass through. This avoids impeding the transport of the packaging unit 2 in the running direction L along the transporting path T.

Elements from the various embodiments described herein can be combined with other elements to form additional embodiments. For example, heating can be provided additionally by an infrared heater or hot air from a rotating heating tape if part of the heating energy is drawn from the connected shrink tunnel. The use of radiators, in particular infrared heaters, is advantageous for all the embodiments described herein because such heaters require only a very small space and need no drive unit, as is the case with the use of hot gas as a heat source. In addition, the use of infrared radiation avoids unwanted gas movements.

Having described the invention, and a preferred embodiment thereof, what is claimed as new, and secured by Letters Patent is:

1. A method comprising packaging groups of articles to form packaging units, wherein packaging said groups comprises receiving a packaging unit that has been wrapped by a piece of film over a top thereof while moving in a running direction on a transporting path during which said packaging unit passes over a front of said piece of film, wherein said packaging unit stands on overlapping ends of said piece of film thereby causing said piece of film to simultaneously form a film cover and flaps, wherein said flaps project beyond said packaging unit along opposite transverse directions that are perpendicular to said running direction, positioning said flaps against said packaging unit as said packaging unit moves through a folding unit, executing a preliminary-fixing step, and executing a definitive-fixing step, thereby forming a film wrapper that is closed on all sides of said packaging unit, wherein executing said preliminary-fixing step comprises passing said packaging unit between parallel heat-sources of a preliminary-fixing unit, moving said parallel heat sources along a path that extends along said running direction, and supplying an air current that applies heat to said flaps and that mechanically loads said flaps so that said flaps are reciprocally positioned and oriented relative to said packaging unit, thereby initially fixing said flaps, and wherein executing a definitive-fixing step comprises exposing said packaging unit, as a whole, to generated heat after having initially fixed said flaps.

2. The method of claim 1, wherein executing said preliminary-fixing step comprises at least partially laminating said flaps.

3. The method of claim 2, wherein at least partially laminating said flaps comprises exposing said flaps to said heat.

4. The method of claim 2, wherein at least partially laminating said flaps comprises exposing said flaps to said parallel heat sources, wherein said parallel heat sources move along said running direction and, after having moved along said path that extends in said running direction, move along said path against said running direction.

5. The method of claim 2, wherein at least partially laminating said flaps comprises using a clamping element for laminating said flaps, wherein said clamping element holds said flaps such that said flaps lie against said packaging unit in a position imposed by said folding unit as said packaging unit moves through said preliminary-fixing unit.

6. The method of claim 5, wherein using a clamping element comprises using a clamping element that is arranged on both sides and parallel to said running direction, wherein, as said packaging unit moves through said preliminary-fixing unit, said clamping element holds said flaps such that said flaps lie against said packaging unit in a position imposed by said folding unit.

7. The method of claim 1, wherein executing said preliminary-fixing step comprises executing said preliminary-fixing step after said packaging unit has passed through said folding unit and before said packaging unit has entered said definitive-fixing unit, wherein said packaging unit moves in said running direction during said preliminary-fixing step and also during said definitive-fixing step.

8. An apparatus comprising a definitive-fixing unit towards which groups of articles that have been combined to form a packaging unit move along a transporting path that leads into said definitive fixing-unit, wherein said definitive-fixing unit is configured for applying heat to said packaging unit as a whole and for definitively fixing flaps of a film cover that surrounds said packaging unit using at least said heat, wherein, when said packaging unit is received by the definitive-fixing unit after having been moved on said transporting path in a running direction thereof, said packaging unit has been covered by a film as a result of having been caused to pass over a front of said piece of film, said piece of film having been wrapped over a top of said packaging unit, wherein said packaging unit is standing on overlapping ends of said piece of film thereby causing said piece of film to simultaneously form a film cover and flaps that project beyond said packaging unit in opposite transverse directions that are perpendicular to said transporting path, wherein said apparatus comprises a fixing device and a folding unit that is separate from said fixing device, wherein said folding unit is configured for positioning said flaps against said packaging unit as said packaging unit passes through said folding unit towards said fixing device, wherein said folding unit is disposed upstream from said fixing device in said running direction, wherein said fixing device is configured to fix said flaps to each other, wherein said fixing device comprises a preliminary-fixing unit and said definitive-fixing unit, wherein said preliminary-fixing unit comprises a moving heat source that moves in a longitudinal direction parallel to said running direction and a source of an air current, wherein said source of an air current is configured for applying heat to said flaps that project in opposite transverse directions for preliminary fixing of said flaps to each other and for mechanically loading said flaps, and wherein said source of an air current is further configured for reciprocal positioning and orientation of said flaps relative to said packaging unit.

9. The apparatus of claim 8, wherein said preliminary-fixing unit is positioned downstream of said folding unit in said running direction, and wherein said definitive-fixing unit is positioned downstream of said preliminary-fixing unit in said running direction.

10. The apparatus of claim 8, wherein said definitive-fixing unit is configured to supply energy to said moving heat source.

11. The apparatus of claim 8, wherein said moving heat source of said preliminary-fixing unit extends into said definitive-fixing unit.

12. The apparatus of claim 8, wherein said preliminary-fixing unit is configured to mechanically load said flaps and wherein said preliminary-fixing unit is further configured to expose said flaps to heat concurrently with loading said flaps.

13. The apparatus of claim 8, wherein said preliminary-fixing unit comprises a clamping element, wherein said clamping element is configured for mechanically loading said flap, and wherein said clamping element is further configured for reciprocal positioning and orientation of said flap relative to said packaging unit.

14. The apparatus of claim 8, wherein said preliminary-fixing unit comprises a clamping element, wherein said apparatus further comprising a coating, wherein said coating is oriented to face said flaps, wherein said coating is disposed on said clamping element, and wherein said coating suppresses adhesion between said clamping element.

15. The apparatus of claim 8, wherein said definitive-fixing unit is disposed downstream of said preliminary-fixing unit along the transporting path in said running direction such that said packaging unit enters said definitive-fixing unit as said packaging unit leaves said preliminary-fixing unit and such that only after said packaging unit has passed through said preliminary-fixing unit does said packaging unit enter said definitive-fixing unit.

16. The apparatus of claim 8, wherein said preliminary-fixing unit comprises a rotating tape that, after having been heated, reradiates heat for laminating said flaps.

17. The apparatus of claim 16, wherein said rotating tape is configured to move at the same speed as said packaging unit along said running direction.

* * * * *